US007072481B2

(12) United States Patent
Button et al.

(10) Patent No.: US 7,072,481 B2
(45) Date of Patent: Jul. 4, 2006

(54) TWO-STAGE PHASING PLUG SYSTEM IN A COMPRESSION DRIVER

(75) Inventors: Douglas J. Button, Simi Valley, CA (US); Alexander V. Salvatti, Northridge, CA (US)

(73) Assignee: Harman International Industries, Inc., Northridge, CA (US)

( * ) Notice: Subject to any disclaimer, the term of this patent is extended or adjusted under 35 U.S.C. 154(b) by 263 days.

(21) Appl. No.: 09/921,149

(22) Filed: Jul. 31, 2001

(65) Prior Publication Data

US 2002/0021815 A1 Feb. 21, 2002

Related U.S. Application Data

(60) Provisional application No. 60/221,692, filed on Jul. 31, 2000.

(51) Int. Cl.
*H04R 25/00* (2006.01)

(52) U.S. Cl. ..... 381/343; 381/340; 181/159

(58) Field of Classification Search ..... 381/339, 381/340, 343; 181/152, 159, 177, 184, 185
See application file for complete search history.

(56) References Cited

U.S. PATENT DOCUMENTS 4,050,541 A 9/1977 Henricksen
4,143,738 A 3/1979 Makazono et al.
4,975,965 A * 12/1990 Adamson ..... 381/343
5,117,462 A 5/1992 Bie
6,064,745 A 5/2000 Avera
6,343,133 B1 * 1/2002 Adamson ..... 381/340

OTHER PUBLICATIONS

Article entitled "An Investigation of the Air Chamber of Horn Type Loudspeakers" published in *The Journal of the Acoustical Society of America*, vol. 25, No. 2, Mar. 1953.

* cited by examiner

*Primary Examiner*—Suhan Ni

(57) ABSTRACT

This invention provides a two-stage phasing plug located within a compression driver. The two-stage phasing plug housed within the compression driver may be coupled to a horn. The two-stage phasing plug includes first and second phasing plugs. The advantages of having a two-stage phasing plug is that the first and second phasing plugs may be simpler to manufacture, cost less and the overall dimensional tolerances may be tightly controlled. The higher dimensional tolerances may be obtained because the first phasing plug may be made from a unitary work-piece, and therefore, may be tooled and cut in the same machining set up. This allows the unitary work-piece to be machined and cut very accurately when compared to assembling separate components together during the manufacturing process. Since the most dimensionally critical area is the rear side of the first phasing plug, the tolerances of the second phasing plug may not be as critical. Thus, a more expensive material, such as steel, may be used for the first phasing plug, and less expensive material, such as plastic, may be used to manufacture the second phasing plug.

41 Claims, 5 Drawing Sheets

FIG. 3
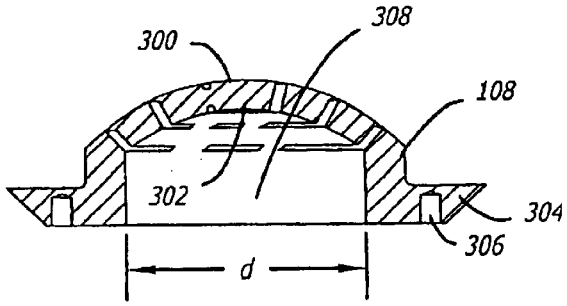
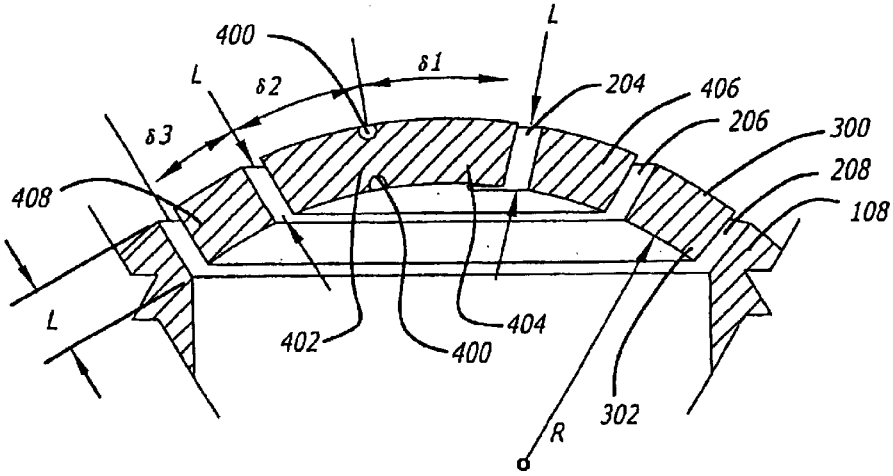
FIG. 4
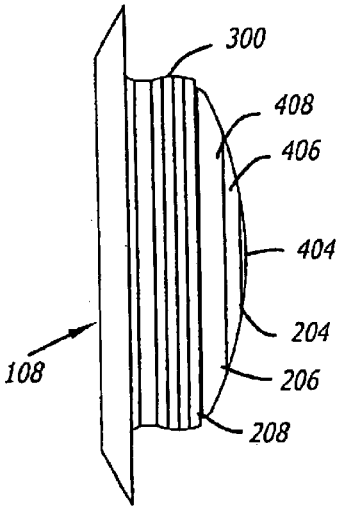
FIG. 5
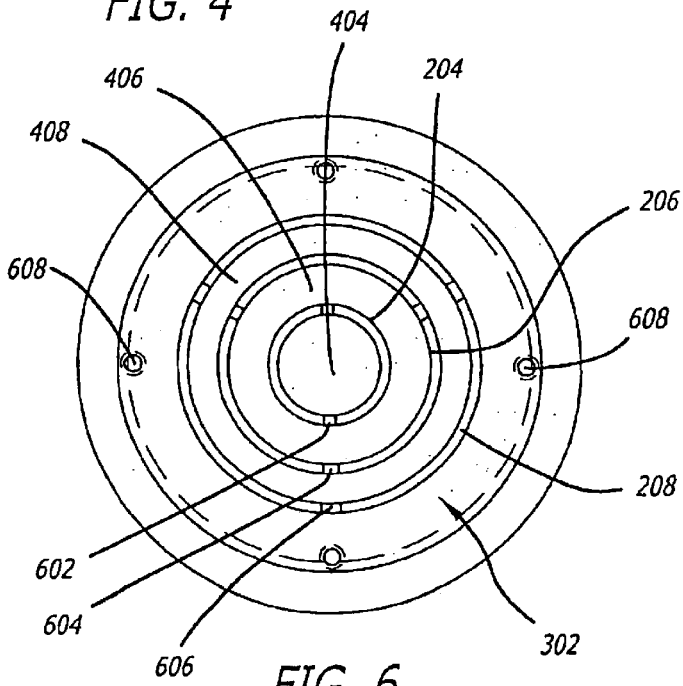
FIG. 6

TWO-STAGE PHASING PLUG SYSTEM IN A COMPRESSION DRIVER

CROSS-REFERENCES TO RELATED APPLICATION

This application is a non-provisional application claiming priority to U.S. Provisional Patent Application, Serial No. 60/221,692 filed Jul. 31, 2000.

BACKGROUND OF THE INVENTION

2. Field of the Invention

This invention relates generally to a compression driver, phasing plug and an assembly of a compression driver phasing plug having a tight dimensional tolerance.

3. Related Art

A compression driver typically comprises a pole piece made of ferromagnetic material having a magnetic air gap to receive a voice coil. The exit or opening of the compression driver is adaptable for coupling to the throat of a horn. A diaphragm, usually circular with a central dome-shaped portion, is mounted adjacent the rear opening of the bore to allow the diaphragm to freely vibrate. Attached to the edge of the diaphragm's dome is a cylindrical coil of wire, the voice coil, oriented so that the cylindrical axis of the coil is perpendicular to the diaphragm and coincident with the axis of the pole piece bore. A static magnetic field, usually produced by a permanent magnet, is applied so that an alternating signal current flowing through the voice coil causes it to vibrate along its cylindrical axis. This in turn causes the diaphragm to vibrate along the axis of the bore and generate sound waves corresponding to the signal current. The sound waves are directed through the bore toward its front opening.

The front opening of the bore is usually coupled to the throat of a horn, which then radiates the sound waves into the air. In the description that follows, the term "throat" is used to mean either downstream end or exiting end of the pole piece bore or the actual entrance of a horn. Interposed between the diaphragm and the pole piece bore is a perforated structure known as a phasing plug for impedance matching the output of the diaphragm to the horn. Within the phasing plug are one or more air passages or channels for transmission of the sound waves. The surface of the phasing plug adjacent to the diaphragm corresponds spherically and is positioned fairly close to the diaphragm while still leaving an air gap, or compression region, in which the diaphragm can vibrate freely.

The phasing plug performs two basic functions. First, because the cross-sectional area of the air channel inlets are smaller than the area of the diaphragm, the air between the diaphragm and the phasing plug (i.e., the compression region) can be compressed to relatively high pressures by motion of the diaphragm. This is what allows a compression driver to output sound at greater pressure levels than conventional loudspeakers where the diaphragm radiates directly into the air. The efficiency of the loudspeaker is thus increased by virtue of the phasing plug being placed in close opposition to the diaphragm to minimize the volume of air between the diaphragm and the phasing plug. Second, as the name "phasing plug" implies, the path lengths of the air channels within the phasing plug may be equalized so as to bring all portions of the transmitted sound wave into phase coherence when they reach the throat. Without such path length equalization, sound waves emanating from different air channels would constructively or destructively interfere with one another at certain frequencies so as to distort the overall frequency response.

Manufacturing the compressor driver phasing plug, however, can be a time consuming and expensive process. For example, to make a compression driver and phasing plug, a number of parts need to be assembled either by gluing or press-fitting the parts together, and then the assembly is machined for finishing. Unfortunately, the labor intensive process of assembling the number of parts adds cost to the manufacturing process. Moreover, the tight dimensional tolerances that must be kept are difficult to achieve. That is, because of the inherent variances that exist in casting each part, when they are combined, the size of the air passages or channels may vary, i.e., one air passage may be smaller or larger than the specification requires, so that there is distortion in the frequency response. Therefore, there is still a need to manufacture a compression driver phasing plug that is easy to manufacture yet with tight dimensional tolerances.

SUMMARY OF THE INVENTION

This invention provides a two-stage compression driver having tight dimensional tolerances. The compression driver may include a two-stage phasing plug having a first phasing plug and a second phasing plug. The first phasing plug is adapted to receive the second phasing plug, and vice versa. When the two phasing plugs are combined, they form the two-stage phasing plug within a compression driver. The first phasing plug may be made of a unitary work-piece that has a rear side and an intermediate side. The rear side of the unitary work-piece may have a dome or convex shape. The thickness between the first side and the intermediate side of the unitary work-piece may be substantially constant so that the intermediate side has a concave shape.

To form slots within the first phasing plug, the unitary work-piece is cut so that slots are formed between the rear and the intermediate sides. In other words, slots are cut within the unitary work-piece to form the first phasing plug. The slots are formed in the work-piece to provide air channels or air passages. In particular, the air channels within the first phasing plug may be equalized so as to bring all portions of the transmitted sound wave into phase coherence when they reach the intermediate side of the first phasing plug. The slots may be formed using a variety of methods known to one ordinarily skilled in the art, such as water jet, laser, and machine tools. With regard to material, the first phasing plug may be made of steel.

The second phasing plug also has an intermediate side and a front side. The intermediate side of the second phasing plug may be adapted to associate or flush with the intermediate side of the first phasing plug. For example, the intermediate side of the second phasing plug may have a convex or dome shape so that it substantially matches the concave shape of the intermediate side of the first phasing plug. The second phasing plug may be formed from different material, such as plastic, than the first phasing plug.

The second phasing plug may be made in a variety of ways. One way is to assemble formed plastic parts that easily "snap" or glue together. The second phasing plug may have slots that form air channels or air passages so that the first and second phasing plugs, when mated, form continuous air channels through the first and second phasing plugs that transmit sound waves into phase coherent or time synchronization when they reach the throat of a horn.

The first and second phasing plugs may be easy to manufacture, cost less, and the overall dimensional tolerance may be tightly held because the first phasing plug is made from a unitary work-piece. Therefore, the phasing plugs may be tooled and cut in the same machining set up. This allows the unitary work-piece to be machined and cut very accurately when compared to assembling separate components together to manufacture a phasing plug. For the phasing plug to perform properly, the rear side of the first phasing plug (i.e., the side adjacent to the diaphragm), needs to be cut or machined accurately to a tight tolerance. The second phasing plug needs to be cut or machined accurately as well, but it is not necessary to cut or assemble the second phasing plug to the same level of precision as the rear side of the first phasing plug. That is, the performance of the two-stage phasing plug depends more on how well the first phasing plug is cut than the second phasing plug. To minimize the cost of manufacturing the two-stage phasing plug, accurately cut steel may be used to manufacture the first phasing plug, and a less expensive material, such as plastic, may be used to assemble the second phasing plug. By using different materials the material costs of the two-stage phasing plug may be reduced.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

FIG. 3 is a cross-sectional view of a first phasing plug.

FIG. 4 is an enlarged view of the first phasing plug of FIG. 3.

FIG. 5 is a side view of the first phasing plug illustrated in FIG. 3.

FIG. 6 is a bottom view of the first phasing plug illustrated in FIG. 3.

DETAILED DESCRIPTION OF THE PREFERRED EMBODIMENTS

Phasing plugs perform two functions. First, the phasing plug provides acoustic load, i.e., acoustic amplification to the throat of the horn. This is done through acoustic impedance matching, and generally depends on the compression ratio and the distance between the diaphragm and the phasing plug. Therefore, to match the impedance, the height of the dome formed in the phasing plug and the width of the slots both need to be accurate because the height of the dome affects the distance between the diaphragm and the phasing plug; and the width of the slots affects the compression ratio. Put differently, because the cross-sectional area of the slots (or air channel inlets) are smaller than the area of the diaphragm, the air between the diaphragm and the phasing plug (i.e., the compression region) can be compressed to relatively high pressures by motion of the diaphragm. This allows a compression driver to output sound at greater pressure levels than conventional loudspeakers where the diaphragm radiates directly into the air. The efficiency of the loudspeaker is thus increased by virtue of the phasing plug being placed in close opposition to the diaphragm to minimize the volume of air between the diaphragm and the phasing plug.

Second, the phasing plug provides equalized path length to its orifice so that all of the transmitted sounds are in phase. Without such path length equalization, sound waves emanating from the different air channels or air passages would constructively or destructively interfere with one another at certain frequencies to distort the overall frequency response. To minimize such distortion and to maximize the impedance matching, the two-stage phasing plug needs to be manufactured to a tight dimensional tolerance. In other words, the path length will be eschewed, if the dimensions deviate from the specified dimensions and, therefore, distortion will occur. Moreover, the shape and height of the dome and the width of the slots on the rear side (the side adjacent to the diaphragm) of the first phasing plug that create the acoustic impedance matching need to be accurate for the two-stage phasing plug to perform properly.

Figure 1:
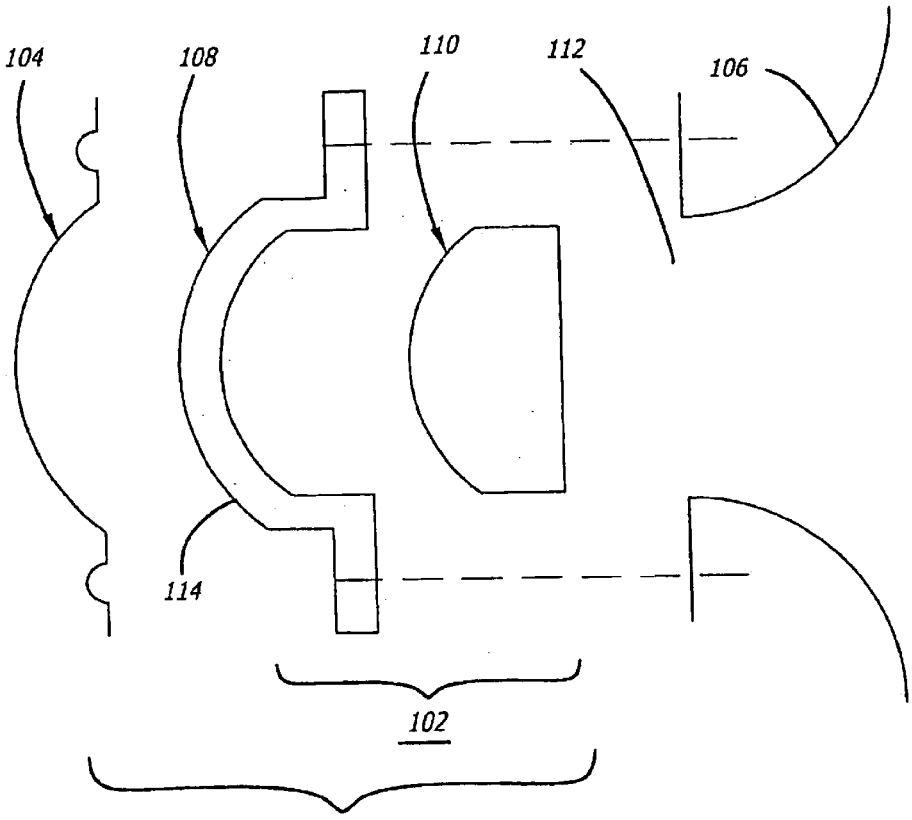
FIG. 1 is an overview of a compression driver having a two-stage phasing plug adapted to couple to a horn.

FIG. 1 illustrates a general overview of a compression driver 100 having a two-stage phasing plug assembly 102 and a diaphragm 104 adapted to couple to a horn 106. The two-stage phasing plug assembly 102, comprised of the first phasing plug 108 and the second phasing plug 110, is adapted to couple to the throat 112 of the horn 106. The diaphragm 104 may be adapted to be juxtaposed to the first phasing plug 108 to drive air through the two-stage phasing plug assembly and then to the throat 112 of the horn 106.

To manufacture a two-stage phasing plug with tight tolerances in the critical areas, the two-stage phasing plug 102 may be divided into two pieces comprising a first phasing plug 108 and a second phasing plug 110. The first phasing plug 108 may be made from a unitary work-piece and is machined to shape the dome surface 114 and its height and may be cut to form the slots (see also FIGS. 2–6). In other words, tolerances can be tightly held because the first phasing plug is machined from a unitary work-piece. With regard to the second phasing plug 110, the accuracy may not be as critical as the dimensional requirements in the first phasing plug. Therefore, the second phasing plug may be assembled from a number of components made of less expensive material, such as plastic, paper material or any material and allows for materials having lower tolerances. Alternatively, the first phasing plug may be assembled from a number of pieces that are glued or fitted together and adapted to associate with the second phasing plug. Also, the second phasing plug may be made from a unitary work-piece as well.

Figure 2:
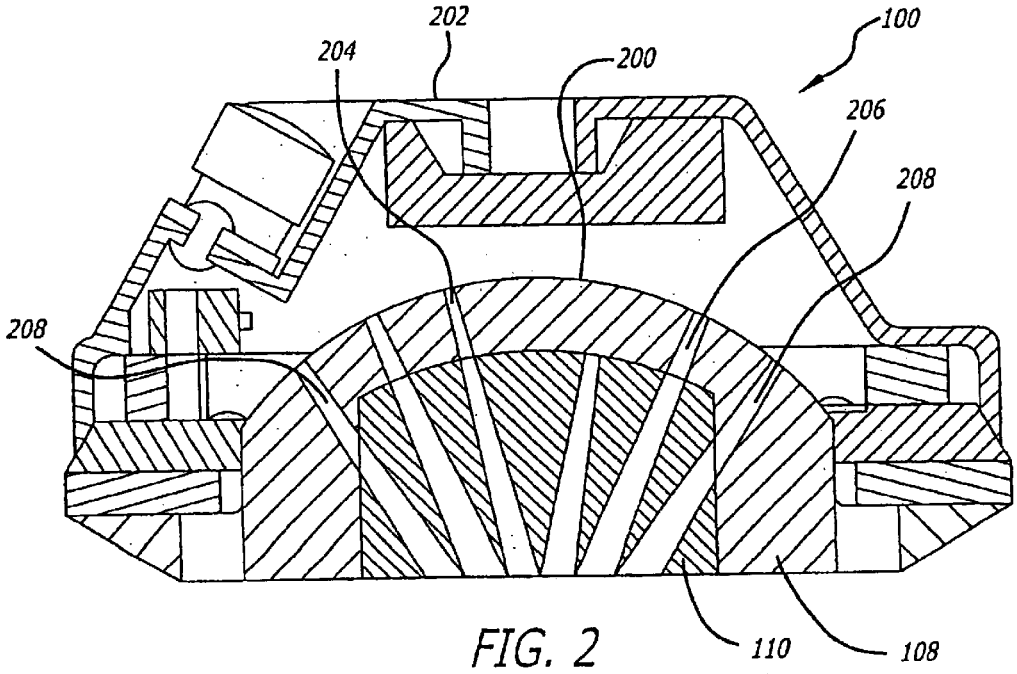
FIG. 2 is a cross-sectional view of a compression driver with a two-stage phasing plug.

FIG. 2 illustrates a cross-sectional view of the two-stage phasing plug assembled within the compression driver 100. A cover 202 encloses the entire assembly. The diaphragm 200 may be adjacent or juxtaposed to the first phasing plug 108. Moreover, the second phasing plug 110 may be flush within the first phasing plug 108 to form the two-stage phasing plug assembly. In this embodiment, a three circular slots 204, 206, and 208 may be formed between the first and second phasing plugs 108, 110 to form air passages or channels so that air between the diaphragm 200 and the first phasing plug 108 may be compressed through the three slots. Compressed air then exit through the throat of the horn.

As illustrated in FIG. 3, the first phasing plug 108 may have a rear side 300 and a first intermediate side 302. In this embodiment, the rear side 300 may have a convex or dome shape, while the first intermediate side 302 may have a concave shape. On the first intermediate side 302, the first phasing plug 108 has a cavity 308 adapted to receive the second phasing plug 110. The cavity 308 may have a cylindrical shape having a diameter "d" and the intermediate side 302 forming a base for the cavity 308. Moreover, the first phasing plug 108 has a flange 304 adapted to couple to the throat 112 of the horn 106 illustrated in FIG. 1. To do so, the flange 304 has a threaded opening 306 to receive a bolt to couple to the throat 112 of the horn.

FIG. 4 illustrates a plurality of slots, three circular slots 204, 206, and 208 in this embodiment, formed between the rear and first intermediate sides 300 and 302. Moreover, the three slots 204, 206, and 208 have a substantially similar slot length L between the rear and first intermediate sides 300 and 302. The slots forming the air channels may expand from the rear side 300 to the first intermediate side 302. That is, the width of the cut on the rear side 300 may be smaller than the width of the cut on the first intermediate side 302. Besides the slots, a pair of indentations 400 may be made forming a first bridge 402 between the pair of indentation so that the inner plate 404 is not cut away from the first phasing plug 108 because of the slot 204. Similar indentations and bridges may be made to hold a center plate 406 and an outer plate 408 in place.

The plurality of slots form air passages or channels so that air between the diaphragm and the rear side 300 may be compressed into the plurality of slots. The radial distance δ1 generally represents the radial diameter of the first slot 204. The radial distance δ2 separates the two slots 204 and 206. The radial distance δ3 separates the two slots 206 and 208. The radial distances δ1, δ2, and δ3 may be substantially similar to the wavelength of the highest frequency the two stage-phasing plug 100 needs to produce such that any cancellation, if at all, occurs at the highest frequency possible outside of the audio band. That is, as the diaphragm compresses, air pressure waves are formed, and some of the pressure waves takes a longer path to the slots than other pressure waves. For instance, pressure waves at the center of two slots must travel, half of the radial distance, i.e., δ/2, further than pressure waves near the same two slots. If distance δ/2 is equal to one-half of the wavelength, then the pressure waves at δ/2 distance from any of the slots are out of phase with the pressure waves near the slots, thus canceling each other.

Put differently, "standing waves" as generally known to one skilled in the art, typically occur in the cavity between the diaphragm and the rear side 300 of the first phasing plug 108, which can interfere with or cancel the pressure waves passing through the slots in the phasing plug. To minimize the interference from the standing waves, the radial distances δ1, δ2, and δ3 may be positioned on the rear side 300 of the first phasing plug 108 based on a methodology developed by Bob Smith in a paper entitled "An Investigation of the Air Chamber of Horn Type Loudspeakers" JASA, Vol. 25, No. 2, published March of 1953, that is incorporated by reference into this application.

As stated in Bob Smith's paper:

Any one of the modes may be suppressed by making the horn throat an annulus which is located at the node, of this mode. If it is necessary to suppress two modes, two annuluses (slots) are required. These annuluses can be located at the nodes of the second mode and thus do not excite it. Each annulus does excite the first node, but the excitation by the second annulus is out of phase with that of the first annulus. By suitable choice of annulus widths, complete cancellation of the first mode results. Thus, the first two modes are suppressed. The process can be carried out for any number of annuluses, i.e., in the general casae of "m" annuluses the first "m" modes can be suppressed.

The air chamber theory developed here suggests the following design procedure: The diaphragm size is selected by the power requirements of the loudspeaker. One then computes the frequencies of the modes associated with this diaphragm from Eq. (13), decides how many modes have to be suppressed, and chooses this number of annuluses. The radii of these annuluses are determined from Eq. (26) and the relative widths from the set of Eqs. (25).

Equation (13) of Bob Smith's paper states that:

The resonant frequencies of the higher modes are $$f_n = p_n c / 2\pi a,$$

and the resonant wavelengths are $\lambda_n = 2\pi a / p_n$, $\lambda_1 = 1.64a$, $\lambda_2 = 0.896a$, $\lambda_3 = 0.618a$, $\lambda_4 = 0.471a$.

Equations (25) and (26) of Bob Smith's paper states that:

The first a modes can be suppressed by letting "j" take on integral values from 1 to m. This produces a set of simultaneous equations:

$$A_1 J_o(k_1 r_1) \ldots A_m J_o(k_1 r_m) = 0$$

$$A_1 J_o(k_m r_1) \ldots A_m J_o(k_m r_m) = 0 \quad (25)$$

Any set of annulus areas and radii which satisfy Eq. (25) will suppress the first m modes. One way of doing this is to choose the radii such that $$J_o(K_m r_i) = 0 i = 1, \ldots m, \quad (26)$$

i.e., choose the radii to be at the nodes of the "m "th mode of Jo. This reduces Eq. (25) to "m−1" equations. These equations can be solved simultaneously for the area of each annulus. For the case of one, two, or three annulus the proper radii and widths of annulus are for m=1: $r_1$=0.628a and $\omega_1$ arbitrary;

for m=2: $r_1$=0.334a, $r_2$=0.788a, $\omega_1$ arbitrary, and $\omega_2$=1.004$\omega_1$;

for m=3: $r_1$=0.238a, $r_2$=0.543a, $r_3$=0.853a, $\omega_1$ arbitrary, $\omega_2$=1.025$\omega_1$, and $\omega_3$=1.065$\omega_1$.

In general, incorporating more slots in the phasing plug further suppresses the lower frequency standing waves. Alternatively, with enough slots in the phasing plug, the occurrence of the standing waves may be outside of the audio band such that the interference may not be noticeable to a listener at all. As such, the radial distances δ1, δ2, and δ3 each may vary depending on the application of the compression driver. In general, the benefit of having more slots is balanced with the increase in cost associated with incorporating more slots into the phasing plug.

For example, the first phasing plug 108 according to FIG. 4 may have the following exemplary dimensions. The slot width for the slot 204 on the rear side 28 may be from about 0.02 inches to about 0.10 inches, and in particular about 0.06 inches; while on the first intermediate side 302, the width of the slot 204 may be from about 0.02 inches to about 0.15 inches, and in particular about 0.077 inches. The width for slots 206 and 208 may be substantially similar to the width of the slot 204. The radial distances δ1, δ2, and δ3 may be about 0.5 inches to provide a compression ratio to be about 6:1 to about 12:1, and in particular about 10:1.

The first phasing plug 108 may be made from a work-piece that has been machined and cut. For example, a work-piece may be initially formed from a cast that is cylindrical in shape. To accurately cut the rear side 300 into a dome surface, the work-piece may be installed in a spindle or lathe and tooled to form the dome shape according to the specification and tolerance. The workpiece may be cut with a tool that is computer controlled so that the rear surface 300 may be cut accurately to form the dome shape in one pass. Other methods known to persons skilled in the art may be used to polish or carve the rear side 300 to satisfy the tolerance requirement. The workpiece may be initially cast or forged with sufficient tolerances that it may not need to be carved or polished to satisfy the specification.

Once the rear surface 300 has been machined, the slots 204, 206, and 208 may be partially pierced between the rear and first intermediate sides 300 and 302. This may be done using a variety of machining tools as known to one skilled in the art. Then, the slots may be cut through the first phasing plug 108 between the rear side 300 and first intermediate sides 302 using a water jet or other suitable cutting mechanism, except for the bridges between the plates 404, 406, and 408. For example, a water jet may be injected from the rear side 300 until it cuts through the first intermediate side 302. With regard to the indentations, the water jet does not cut in those areas. One of the advantages with the water jet is that it expands as it cuts so that the water jet naturally makes the slots 204, 206, and 208 that expand from the rear side 300 to the first intermediate side 302. Therefore, there is no additional machining that needs to be done to expand the slots or air channels from the rear side 300 to the first intermediate side 302. Alternatively, a laser, cutting tools, or plasma cutting methods or any other methods known to one skilled in the art may be used to cut the slots as well.

FIG. 5 illustrates a side view of the first phasing plug 108 that has been machined on the rear side 300 to form a dome shape having a particular dimensional tolerance, and cut to have the slots 204, 206, and 208. The slot 204 defining the inner plate 404, the slot 206 defining the center plate 406, and the slot 208 defining the outer plate 408.

FIG. 6 illustrates the bottom view of the first phasing plug 108 showing the first intermediate side 302. Although the dimensional tolerance on the first intermediate side 302 may not be as critical as the rear side 300, the first intermediate side 302 may be machined as well so that the thickness between the rear and first intermediate sides 300, 302 is substantially constant. Again the slot 204 defines the inner plate 404. The center plate 406 is between the two slots 204 and 206. And the outer plate 408 is between the two slots 206 and 208. To hold the plates together, an inner bridge 602 is formed between the inner plate 404 and the center plate 406, a center bridge 604 is formed between the center plate 406 and the outer plate 408, and an outer bridge 606 is formed between the outer plate 408 and the edge 608 of the first phasing plug 108. Moreover, a number of threaded openings 608 are formed to receive a bolt to couple to the throat of a horn.

Figure 7:
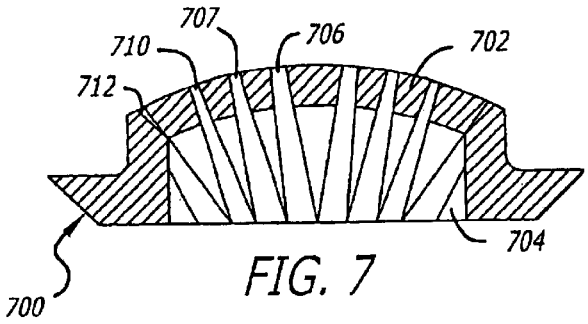
FIG. 7 is a cross-sectional view of another embodiment of a two-stage phasing plug.
Figure 8:
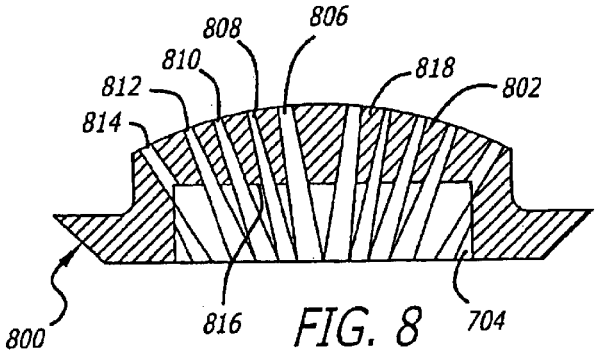
FIG. 8 is a cross-sectional view of another embodiment of a two-stage phasing plug.

The two-stage phasing plug may have a number of slots depending on the application. For instance, FIG. 7 illustrates a two-stage phasing plug 700 including a first phasing plug 702 and a second phasing plug 704 with four slots 706, 708, 710, and 712. And FIG. 8 illustrates a two-stage phasing pug 800 including a first phasing plug 802 and a second phasing plug 804 with five slots 806, 808, 810, 812, and 814. Note that in this example, the first intermediate side 816 is substantially flat rather than being concave as in the other embodiments. With additional slots in the two-stage phasing plug, the radial distances need to be smaller to accommodate more slots on the rear side 818. As such, to maintain the compression ratio on the compression driver, which may be generally defined as the overall surface area of the rear side of the first phasing plug in relation to the overall opening area of the slots on the rear side, the width of the slots need to be reduced as well. In general, the compression ratio may be between about 6:1 and about 12:1, and in particular about 10:1.

As illustrated in FIG. 8, the thickness between the first intermediate side 816 and the rear side 818 need not be constant. For example, the first intermediate side 816 or the base of the cavity may be a substantially flat surface rather than being a curved surface as illustrated in FIG. 3.

Figure 9:
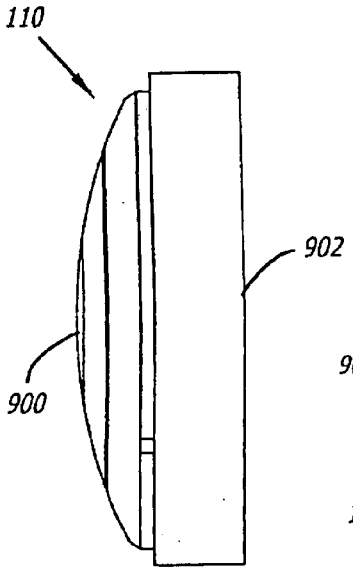
FIG. 9 is a side-view of a second phasing plug.

FIGS. 9–12 illustrate by way of example the second phasing plug 110 configured to substantially fill the cavity 308 of the first phasing plug 108 illustrated in FIG. 3. FIG. 9 illustrates the second phasing plug 110 having a second intermediate side 900 and a front side 902. The second intermediate side 900 substantially matches the shape of the first intermediate side 302 so that when the first and second intermediate sides are adjacent they are substantially flush together. In other words, there is little gap, if any, between the first and second intermediate sides 302, 900.

Figure 10:
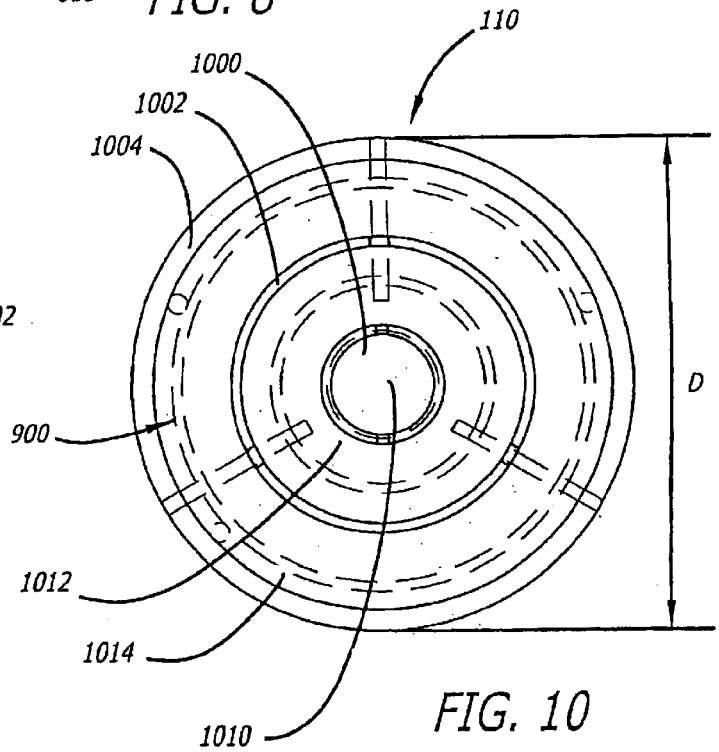
FIG. 10 is a top view of a second phasing plug of the embodiment illustrated in FIG. 8.

As illustrated in FIG. 10, the second phasing plug 110 has a plurality of slots 1000, 1002, and 1004 that correspond to the slots 204, 206, and 208, respectively, in the first phasing plug 108. Moreover, the slot 1000 generally defines an inner piece 1010. Between the two slots 1000 and 1002 is a centerpiece 1012, and between the slots 1002 and 1004 is an outerpiece 1014. That is, the second intermediate side 900 is comprised of the inner piece 1010, the centerpiece 1012, and the outerpiece 1014, which flush against the inner plate 404, the center plate 406, and the outer plate 408 on the first intermediate side 302 of the first phasing plug 108, respectively. In other words, the second intermediate side 900 substantially matches the first intermediate side 302 so that when the second phasing plug 110 is inserted into the cavity of the first phasing plug 108, the second intermediate side 900 may be substantially flush against the first intermediate side 302. To substantially fill the cavity 308, the second phasing plug 108 may have a cylindrical shape with a diameter "D" that is equal or slightly less than the diameter "d" of the cavity 308 in FIG. 3. Therefore, the second phasing plug 108 may be press-fitted into the cavity 308. Alternatively, glue may be used to securely hold the second phasing plug 110 within the cavity 308 of the first phasing plug 108.

In another embodiment, the second phasing plug 110 may be interchangeable so that the compression assembly 100 may be adaptable for a particular application by simply changing the second phasing plug. That is, the second phasing plug may be releaseably held in the cavity of the first phasing plug, so that the second phasing plug may be removed and replaced with a different phasing plug depending on the application.

Figure 11:
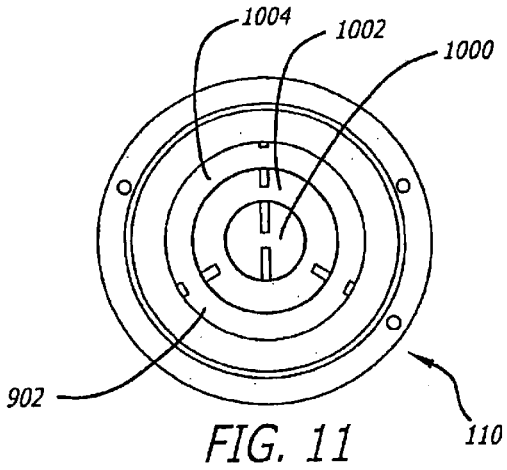
FIG. 11 is a bottom view of a second phasing plug illustrated in FIG. 8.
Figure 12:
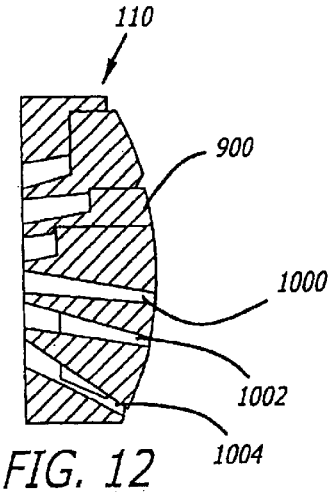
FIG. 12 is a cross-sectional view of a second phasing plug of the embodiment illustrated in FIG. 8.

FIG. 11 illustrates the slots 1000, 1002, and 1004 exiting through the front side 902 of the second phasing plug 110. As illustrated in FIG. 12, the slots 1000, 1002, and 1004 expand from the second intermediate side 900 to the front side 902, i.e., the exit side. Moreover, the width of the slots 1000, 1002, and 1004 in the second intermediate side 900 are substantially similar to the corresponding slots 204, 206, and 208 on the first intermediate side 302. This way, the slots forming the path lengths or air channels from the first and second phasing plugs transition smoothly and continuously. In this embodiment, the front side 902 is substantially flat such that the second phasing plug may be fully inserted into the cavity 308, as shown in FIG. 2. Alternatively, the front side 52 may extend into the throat 112 of the horn 106.

The second phasing plug 110 may be assembled using a variety of methods. One such method is illustrated in FIGS. 13–18. As dimensional accuracy in the second phasing plug 110 is not as critical as in the first phasing plug 108, the second phasing plug may be assembled together, unlike the first phasing plug 108, which may be made from a unitary work-piece. That is, in this embodiment, an inner piece 1300, the centerpiece 1400, the outerpiece 1600, and a housing 1800 are assembled to make the second phasing plug 110.

Figure 13:
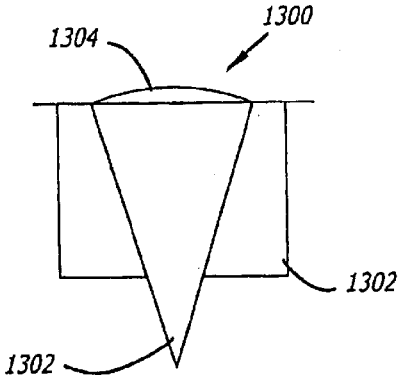
FIG. 13 is a side view of an inner piece of the second phasing plug illustrated in FIG. 8.
Figure 14:
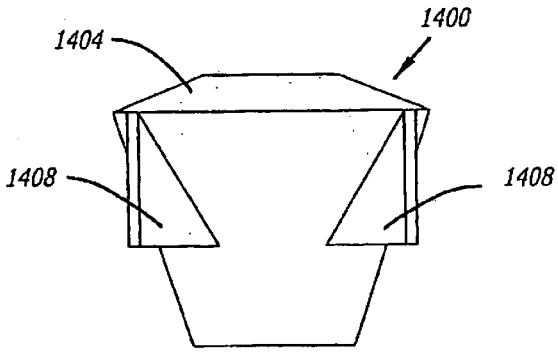
FIG. 14 is a side view of a centerpiece within the second phasing plug illustrated in FIG. 8.
Figure 15:
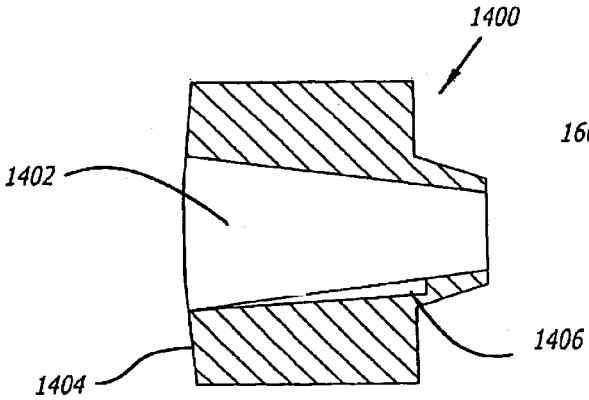
FIG. 15 is a cross-sectional view of the embodiment illustrated in FIG. 14.

FIG. 13 illustrates the inner piece 1300 having a cone shape with a pair of flanges 1302. The inner piece 1300 has an inner surface 1304 that is a portion of the second intermediate side 900, which flush against the inner plate 404 along the first intermediate side 302 of the first phasing plug 108. FIGS. 14 and 15 illustrate the centerpiece 1400 having a funnel shape with a bore 1402; and a center surface 1404 that is a portion of the second intermediate side 900 and fits flush against the center plate 406 of the first phasing plug 108. Moreover, the centerpiece 1400 has a pair of divots 1406 adapted to receive the pair of flanges 1302, so that the inner piece 1300 may be press-fitted into the bore 1402 of the centerpiece 1400. Likewise, the centerpiece 1400 has three flanges 1408 so that the centerpiece may be press-fitted into the outerpiece 1600.

Figure 16:
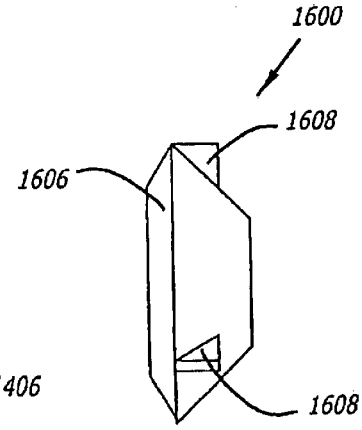
FIG. 16 is a side view of an outerpiece within the second phasing plug illustrated in FIG. 8.
Figure 17:
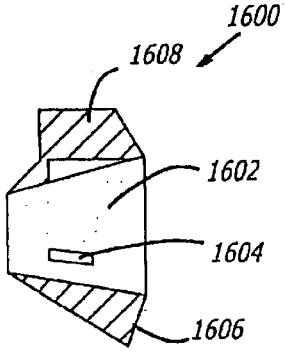
FIG. 17 is a cross-sectional view of the outerpiece illustrated in FIG. 16.

FIGS. 16 and 17 illustrate the outerpiece 1600 having a funnel shape as well. The outerpiece 1600 has an opening 1602, and three divots 1604 adapted to receive the three flanges 1408 from the centerpiece 1400. That is, the centerpiece 1400 may be press-fit into the opening 1602 of the outerpiece 1600. Likewise, the outerpiece 1600 has an outer surface 1606 that fits flush against the outer plate 408 of the first phasing plug 108. Moreover, the outerpiece 1600 has three flanges 1608.

Figure 18:
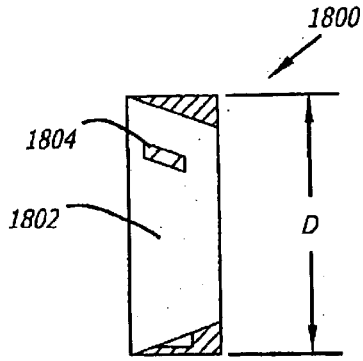
FIG. 18 is a cross-sectional view of a housing forming the second phasing plug of the embodiment illustrated in FIG. 8.

FIG. 18 illustrates the housing 1800 having a cylindrical shape with a diameter "D" and an opening 1802. Within the opening 1802 are three divots 1804 which are adapted to receive the three flanges 1608 so that the outerpiece 1600 may be press-fit into the housing 1800. Accordingly, the second phasing plug 108 as shown previously in FIGS. 9–12 may be assembled by press-fitting the inner piece 1300 into the center piece 1400, then press-fitting the center piece 1400 into the outerpiece 1600, and then press-fitting the outerpiece 1600 into the housing 1800.

Figure 19:
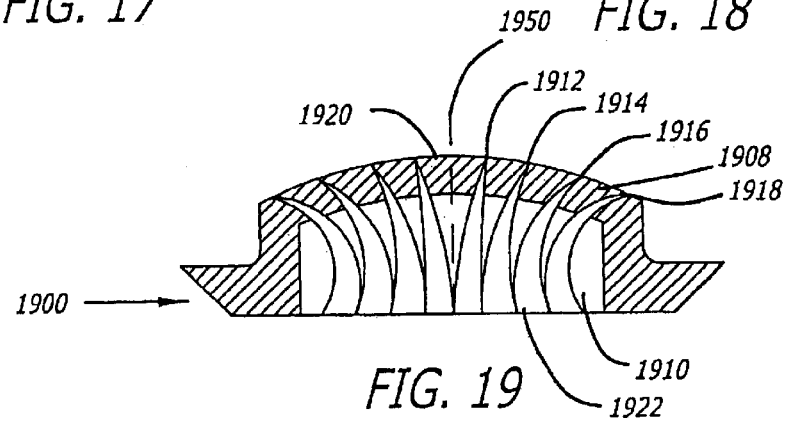
FIG. 19 is a cross-sectional view of an alternative two-stage phasing plug.

With regard to the expansion of the slots through the two-stage phasing plug 102, the slots may expand gradually in a straight line through the first phasing plug 108 and then to the second phasing plug 110, as illustrated in FIG. 2. Alternatively, as illustrated in FIG. 19, the first phasing plug 1908 may have slots 1912, 1914, 1916, and 1918 expanding gradually in a straight line but in the second phasing plug 1910, the slots 1912, 1914, 1916, and 1918 expand in a curve or in any conic profile, i.e., hyperbolic, parabolic, etc. shape so that the length of the each slots through the two-stage phasing plug 1900 between the rear side 1920 and the front side 1922 are substantially constant. Moreover, the slots 1912, 1914, 1916, and 1918 exit through the second phasing plug 1910 substantially parallel with the center axis 1950. That is, air exits through the slots substantially parallel with the center axis 1950.

Figure 20:
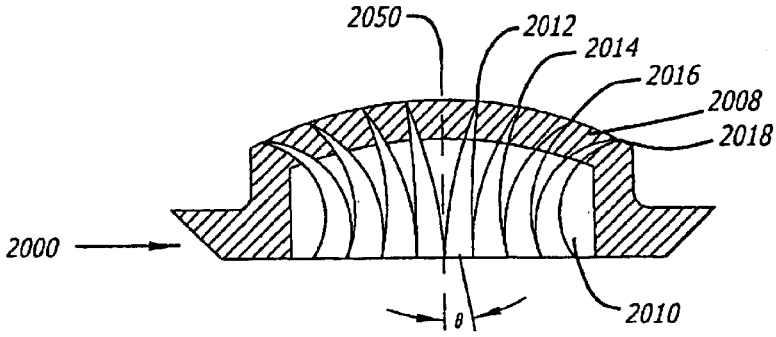
FIG. 20 is a cross-sectional view of another embodiment of the two-stage phasing plug.

Still further, as illustrated in FIG. 20, in another embodiment, a two-stage phasing plug 2000 may have slots 2012, 2014, 2016, and 2018 through the first phasing plug 2008 that expand in a curve or in any conic profile, i.e., hyperbolic, parabolic, etc. shape as well as in the second phasing plug 2010. Here, the first phasing plug 2008 may be assembled from a number of pieces rather than being formed from a unitary piece. Also, the slots 2012, 2014, 2016, and 2018 exit through the front side 2022 of the second phasing plug 2010 at an acute angle relative to the center axis line 2050. In other words, as air exit through the slots 54, air diverges off of the center axis line 2050 at an acute angle $\Phi$, such as between about 5° and about 25°. One of the advantages here is that as air exit through the slots 2012, 2014, 2016, and 2018 in a divergent direction so that the direction of the air is in alignment with the contour of a horn that flares out as well. In other words, with this embodiment, pressure waves leave the slots in the direction that conforms to the shape of the horn.

Figure 21:
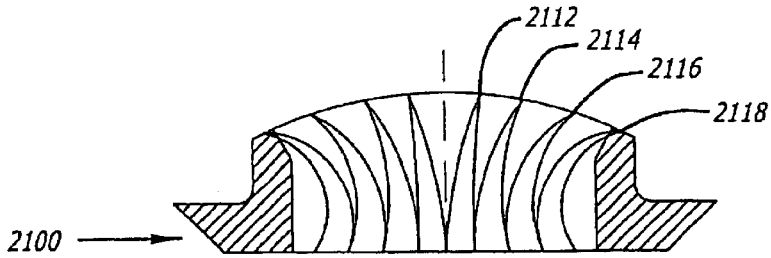
FIG. 21 is a cross-sectional view of a phasing plug.

FIG. 21 illustrates yet another embodiment of the invention, where a phasing plug 2100 may be made of a number of pieces rather than in two stages as discussed above. That is, slots 2112, 2114, 2116, and 2118 may be formed through the phasing plug 2100 which are curve comprised of number of pieces assembled together like the second phasing plug 110 assembled together as illustrated in FIGS. 9 through 12.

The first phasing plug may be made of any ferromagnetic material such as steel. Alternatively, any other materials known to one skilled in the art may be used as well. The second phasing plug, on the other hand, may be made of less expensive and easier to work with material such as plastic or any material known to one skilled in the art. Any method may be used to make the second phasing plug, such as well-known molding processes. Also, machining and cutting processes are well known to one skilled in the art and may be selected based on the tolerance requirements.

Although the invention is generally described in terms of the one embodiment above, numerous modifications and/or additions to the above-described embodiment would be readily apparent to one skilled in the art. For example, the slots may be cut in any configuration. U.S. Pat. No. 4,050,541, is incorporated by reference into this application and discloses a radial slot configuration. U.S. Pat. No. 5,117,462, is incorporated by reference into this application discloses a whole array. The first intermediate surface 302 may also have a convex surface rather than a concave surface.

Phasing plugs have been made with many designs. Perhaps the most frequently used type is one having annular cross-sections that usually increase in area as the principal radius of each annulus decreases in moving toward the throat of a speaker. This is shown, for example, in U.S. Pat. No. 2,037,187, entitled "Sound Translating Device," issued to Wente in 1936 and incorporated by reference. Another type is the salt shaker design, so called because holes at the spherical outer surface of the plug that extend through to the throat of the speaker resemble the holes of a salt shaker. Another design that has been used, shown in U.S. Pat. No. 4,050,541, entitled "Acoustical Transformer for Horn-type Loudspeaker," couples the diaphragm region to the throat by radial slots extending from the axis of cylindrical symmetry of the speaker and is incorporated by reference into this application.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A phasing plug assembly, comprising:

a first phasing plug;

a second phasing plug positioned substantially adjacent to the first phasing plug, both the first and second phasing plugs having a plurality of openings extending through both the first and second phasing plugs; and where the first phasing plug has a rear side and a first intermediate side and the second phasing plug has a second intermediate side and front side and where the first intermediate side of the first phasing plug and the second intermediate side of the second phasing plug are positioned adjacent to one another in the assembly.

2. The assembly of claim 1, where the first phasing plug has a cavity and at least a portion of the second phasing plug is adapted to fit within the cavity of the first phasing plug.

3. The assembly of claim 2, where the cavity in the first phasing plug forms a first intermediate side of the first phasing plug and where the at least a portion of the second phasing plug that is adapted to fit within the cavity of the first phasing plug forms a second intermediate side that when positioned with the cavity of the first phasing plug fits substantially flush against the first intermediate side of the first phasing plug.

4. The assembly of claim 2, where the at least a portion of the second phasing plug that first within the cavity of the first phasing plug is affixed to the first phasing plug.

5. The assembly of claim 2, where the second phasing plug substantially fills the cavity of the first phasing plug.

6. The assembly of claim 1, where the first phasing plug has a flange.

7. The assembly of claim 1, where the rear side of the first phasing plug is generally spherical in shape.

8. The assembly of claim 1, where the rear side of the first phasing plug is adapted to be positioned adjacent to a diaphragm in a speaker assembly.

9. The assembly of claim 1, where the plurality of openings are circular openings positioned about the rear side of the first phasing plug.

10. The assembly of claim 1, where the distance between the plurality of openings is about 0.5 inches.

11. The assembly of claim 1, where the plurality of openings form three rigns, a first ring within a second ring, and the second ring within a third ring.

12. The assembly of claim 11, where the three rings are spaced substantially equidistant from one another.

13. The assembly of claim 1, where the plurality of openings are spaced apart from one another to minimize standing waves.

14. The assembly of claim 11, where the plurality of openings further includes a fourth ring, where the third ring is inside the fourth ring.

15. The assembly of claim 1, where the plurality of openings form a compression ratio from about 12:1 to about 12:1 between the rear side of the first phasing plug and the diaphragm.

16. The assembly of claim 1, where the first phasing plug is made of steel.

17. The assembly according to claim 1, where the second phasing plug is made of plastic.

18. The assembly according to claim 1, where the thickness between the rear side and the first intermediate side of the first phasing plug is substantially constant.

19. The assembly according to claim 1, where the second phasing plug is interchangable.

20. The assembly of claim 1, where the first phasing plug is construction from a unitary work-piece.

21. The assembly of claim 1, where the second phasing plug is assembled from at least separate two pieces.

22. The assembly of claim 1, where the second phasing plug is constructed from a unitary work-piece.

23. The assembly of claim 1, where the plurality of openings includes a first plurality of openings and a second plurality of openings, where the first plurality of openings extend from the rear side to the first intermediate side of the first phasing plug and the second plurality of openings extends from the second intermediate side to the front side of the second phasing plug, and where the size of the first plurality of openings are substantially similar to the plurality of openings to provide a continuous transition between the first and second plurality of openings.

24. The assembly of claim 23, where the second plurality of openings are substantially straight as the extend through the second intermediate side to the front side of the second phasing plug.

25. The assembly of claim 23, where the second plurality of openings form a curve as they extend from the intermediate side of the second phasing plug to the front side of the second phasing plug.

26. The assembly of claim 23, where the first and second phasing plugs have a center axis and where the second plurality of openings in the second phasing plug exits through the front side substantially parallel to the center axis.

27. The assembly of claim 23, where the first and second phasing plugs have a center axis, where the second plurality of openings in the second phasing plug exit through the front side at an acute angle relative to the center axis.

28. The assembly of claim 27, where the acute angle is less than about 25°C.

29. The assembly of claim 23, where the first plurality of openings are substantially straight as they extend through the rear side of the first phasing plug to the first intermediate side of the first phasing plug, and the second plurality of openings substantially curve as they extend through the second intermediate side of the second phasing plug to the front side of the second phasing plug.

30. The assembly of claim 1, where the plurality of openings curve from a rear side of the first phasing plug to a front side of the second phasing plug as they extend through the first and second phasing plugs.

31. The assembly of claim 1, where each of the plurality of openings is of a substantially equal length measured between a rear side of the first phasing plug and a front side of the second phasing plug.

32. A phasing plug assembly comprising:

a first phasing plug made of steel having a plurality of openings through the first phasing plug; and a second phasing plug having a plurality of openings aligning with the plurality of openings in the first phasing plug when the second phasing plug is placed adjacent to the first phasing plug, where the first phasing plug has a rear side and a first intermediate side and the second phasing plug has a second intermediate side and front side and where the first intermediate side of the first phasing plug and the second intermediate side of the second phasing plug are positioned adjacent to one another in the assembly.

33. The assembly of claim 32, where the second phasing plug is made of steel.

34. The assembly of claim 32, where the second phasing plug is made of plastic.

35. The assembly of claim 32, where the second phasing plug is formed from a unitary steel piece.

36. The assembly of claim 32, where the second phasing plug is formed from at least two pieces.

37. The assembly of claim 32, where the first phasing plug has a cavity and at least a portion of the second phasing plug and adapted to fit within the cavity of the first phasing plug.

38. The assembly of claim 37, where the cavity in the first phasing plug forms a first intermediate side of the first phasing plug and where the at least of portion of the second phasing plug that is adapted to fit with the cavity of the first phasing plug forms a second intermediate side that when positioned with the cavity of the first phasing plug fits substantially flush against the first intermediate side of the first phasing plug.

39. The assembly according to claim 1, where the first phasing plug has a rear side and a first intermediate side, and a first plurality of slot openings between the rear and first intermediate sides of the first phasing plug, the second phasing plug having a second intermediate side and a front side, and a second plurality of slot openings between the second intermediate and front sides of the second phasing plug, wherein the first plurality of slot openings on the first intermediate side of the first phasing plug is juxtaposed to the second plurality slot openings on the second intermediate side of the second phasing plug to form the plurality of openings through both the first and second phasing plugs.

40. The assembly according to claim 39, where the rear side of the first phasing plug is domed shaped.

41. The assembly according to claim 39, where the first and second phasing plugs are made of different materials.

* * * * *